US012359543B2

(12) United States Patent
Al-Anazi et al.

(10) Patent No.: US 12,359,543 B2
(45) Date of Patent: Jul. 15, 2025

(54) GAS AND WATER BREAKTHROUGH DETECTION

(71) Applicant: Saudi Arabian Oil Company, Dhahran (SA)

(72) Inventors: Ammal F. Al-Anazi, Dammam (SA); Wenrong Mei, Ras Tanura (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/197,938

(22) Filed: May 16, 2023

(65) Prior Publication Data

US 2024/0384632 A1 Nov. 21, 2024

(51) Int. Cl.

| | |
|---|---|
| ***E21B 43/12*** | (2006.01) |
| ***E21B 43/16*** | (2006.01) |
| ***E21B 49/08*** | (2006.01) |

(52) U.S. Cl.

CPC ..... *E21B 43/122* (2013.01); *E21B 43/164* (2013.01); *E21B 49/0875* (2020.05)

(58) Field of Classification Search

CPC ..... E21B 49/08; E21B 49/00; E21B 49/005; E21B 43/16; E21B 43/00; E21B 47/00; E21B 49/087

See application file for complete search history.

(56) References Cited

U.S. PATENT DOCUMENTS

2018/0362842 A1* 12/2018 Bello ..... C09K 8/86

FOREIGN PATENT DOCUMENTS

| | | |
|---|---|---|
| CA | 2985953 A1 * | 5/2019 |
| EP | 1706710 | 10/2006 |

OTHER PUBLICATIONS

Veeken et al., "Early Detection of Gas Well Formation Damage, Water Breakthrough and Liquid Loading by Use of Surface Pressure Build-Up Data," Presented at the SPE European Formation Damage Conference and Exhibition, Jun. 3-5, 2015, 1 page (Abstract only).

Offshore-mag.com [online], "Identifying injection gas breakthrough in multi-zone condensate reservoirs," Aug. 1, 2000, retrieved on Jan. 2, 2024, retrieved from URL <https://www.offshoremag.com/production/article/16763555/identifying-injection-gas-breakthrough-in-multi-zone-condensate-reservoirs>, 8 pages.

* cited by examiner

*Primary Examiner* — Zakiya W Bates
(74) *Attorney, Agent, or Firm* — Fish & Richardson P.C.

(57) ABSTRACT

Example computer-implemented methods and systems for gas and water breakthrough detection in producing wells. One example computer-implemented method includes receiving flow rate measurement data of produced gas and produced oil of a producing well in a subsurface reservoir. Composition measurement data of the produced gas and the produced oil are received. An occurrence of a producing well breakthrough of gas injected into the subsurface reservoir from one or more injection wells is detected based on the received flow rate measurement data and the received composition measurement data.

7 Claims, 5 Drawing Sheets

GAS AND WATER BREAKTHROUGH DETECTION

TECHNICAL FIELD

The present disclosure relates to computer-implemented methods and systems for gas and water breakthrough detection in producing wells.

BACKGROUND

Gas and water can be injected into a subsurface oil-bearing reservoir through injection wells to maintain reservoir pressure. Gas or water breakthrough can occur when the injected gas or water breaks through to one or more of the producing wells in the oil-bearing reservoir.

SUMMARY

The present disclosure involves computer-implemented methods and systems for gas and water breakthrough detection in producing wells. One example computer-implemented method includes receiving flow rate measurement data of produced gas and produced oil of a producing well in a subsurface reservoir. Composition measurement data of the produced gas and the produced oil are received. An occurrence of a producing well breakthrough of gas injected into the subsurface reservoir from one or more injection wells is detected based on the received flow rate measurement data and the received composition measurement data. Oil recovery from the producing well is enhanced based on the detected occurrence of the producing well breakthrough of the injected gas.

While generally described as computer-implemented software embodied on tangible media that processes and transforms the respective data, some or all of the aspects may be computer-implemented methods or further included in respective systems or other devices for performing this described functionality. The details of these and other aspects and implementations of the present disclosure are set forth in the accompanying drawings and the description below. Other features, objects, and advantages of the disclosure will be apparent from the description and drawings, and from the claims.

BRIEF DESCRIPTION OF DRAWINGS

Like reference numbers and designations in the various drawings indicate like elements.

DETAILED DESCRIPTION

Figure 1:
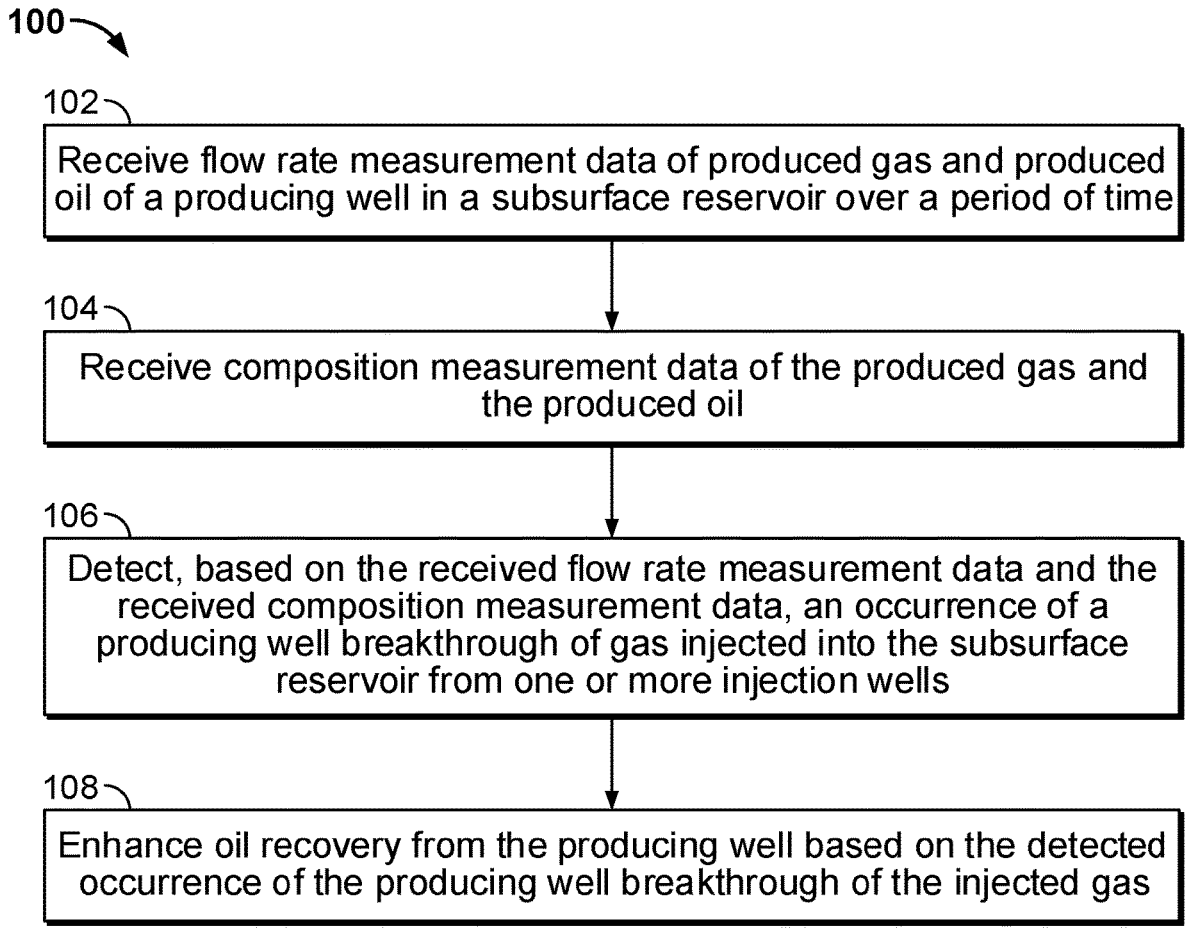
FIG. 1 illustrates an example workflow for determining an occurrence of gas breakthrough into a producing well, according to some implementations.

This disclosure relates to composition-based gas and water breakthrough detection in producing wells. A breakthrough detection system can perform the detection by analyzing the compositions of produced hydrocarbon or the salinity of produced water from a subsurface oil-bearing reservoir or field that is under the pressure maintenance by lean gas injection or water injection.

Injected gas or water can be used to displace in-situ oil to producing wells. When a breakthrough of injected gas or water occurs, the injected gas or water can find paths from the injector to the producing wells, and less in-situ oil will be displaced to the producing wells. Therefore, gas or water injection becomes less efficient in terms of sweeping oil for recovery.

When a breakthrough of injected gas in producing wells occurs, the produced gas from the producing wells can be a mixture of formation gas and the injected gas. The injected gas primarily contains lighter carbon numbers such as $C_1$ and $C_2$. An increasing trend of the mole fractions of $C_1$ and $C_2$ in produced gas over time can indicate that injected gas has entered into the producing wells due to gas breakthrough.

The produced water during a breakthrough of injected water in producing wells can be a mixture of formation water and injected fresher water. A decreasing trend of the salinity of produced water over time can be used as an indicator for the identification of the breakthrough of injected water in producing wells. Additionally, an increasing trend of water cut of the produced water from the producing wells can be combined with the aforementioned decreasing trend of the salinity of produced water to detect the breakthrough of injected water in producing wells.

A surface inline multiphase tester or multiple testing units can be used to measure the compositions of produced hydrocarbons and the salinity of produced water. The compositions of in-situ oil from a producing zone can be obtained from an initial pressure-volume-temperature (PVT) analysis report, and the compositions of injected gas can also be analyzed through the multiphase tester. The salinity of the original formation water can be obtained from the geochemical report of water samples from exploration wells in the same field or the same reservoir. As the field is being produced, the continuous analysis of both the compositions of produced hydrocarbon and the salinity of produced water can enable the identification of increase of compositions in the lighter carbon numbers of the compositions of produced hydrocarbon and drop of salinity of the produced water. The identification can flag gas breakthrough or water breakthrough.

When a breakthrough of gas or water is detected, existing perforations for gas or water injection can be cement-squeezed off, and the formation can be re-perforated in different intervals in order to change the flowing paths for the injected gas or water for displacing in-situ oil. Numerical simulation can also be performed to find any trapped oil zones where new in-fill wells can be drilled.

FIG. 1 illustrates an example workflow 100 for determining an occurrence of gas breakthrough into a producing well. In some implementations, to detect the gas breakthrough into a producing well, the breakthrough detection system collects different fluid flow measurement data, water salinity measurement data, and hydrocarbon composition measurement data. For convenience, workflow 100 will be described as being performed by a system of one or more computers (e.g., the breakthrough detection system), located in one or more locations, and programmed appropriately in accordance with this specification.

In step 102, a computer system receives flow rate measurement data of produced gas and produced oil of a producing well in a subsurface reservoir that is measured over a period of time. In some implementations, the flow rate measurement data of produced gas and produced oil can be measured using a multiphase tester. The multiphase tester can be a surface multiphase tester located downstream of a wellhead. An example multiphase tester is the phase tester 308 of FIG. 3.

Figure 3:
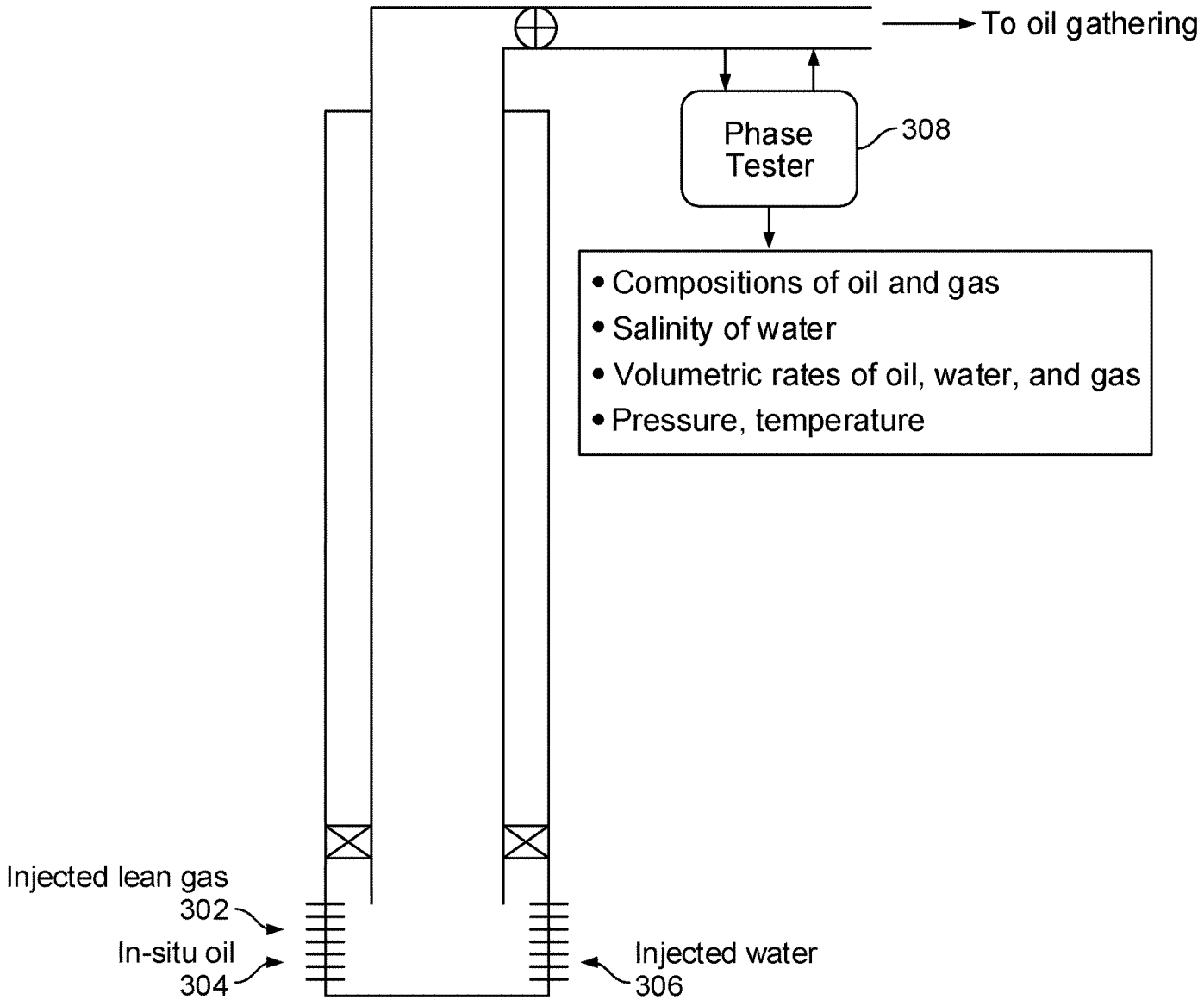
FIG. 3 illustrates a schematic of an oil-bearing reservoir under gas and water injection, according to some implementations.

FIG. 3 illustrates a schematic of an oil-bearing reservoir under gas and water injection. The injected lean gas 302 and injected water 306 can be put into a subsurface oil-bearing reservoir for pressure maintenance of the oil-bearing reservoir. The injected lean gas 302 and injected water 306 can be from one or more injection wells in the subsurface reservoir, for example, from injection wells adjacent to the producing well. A phase tester 308 can be used to measure the flow rates of produced oil, gas, and water from a producing well in the oil-bearing reservoir. The phase tester 308 can be a surface multiphase tester located downstream of a wellhead. The phase tester 308 can also measure the compositions of produced hydrocarbon and the salinity of produced water of the producing well. Additionally, the phase tester 308 can measure the compositions of gas injected into the subsurface oil-bearing reservoir, for example, injected lean gas 302. Other data, for example, pressure and temperature of produced fluid stream, can also be measured by phase tester 308.

Returning to FIG. 1, in step 104, the computer system receives composition measurement data of the produced gas and the produced oil. In some implementations, the composition measurement data of gas injected into the subsurface reservoir, for example, injected lean gas 302 of FIG. 3, can be measured by phase tester 308 of FIG. 3. The composition measurement data can include mole fraction measurement data of the compositions of the injected gas.

In step 106, the computer system detects, based on the received flow rate measurement data and the received composition measurement data, an occurrence of a breakthrough of gas injected into the subsurface reservoir from one or more injection wells. In some implementations, this detection involves two steps.

In the first step, the computer system determines, based on the received flow rate measurement data, that a first increasing trend of gas oil ratio (GOR) of the produced gas and the produced oil occurs within a predetermined period of time. The computer system can calculate the GOR as a ratio of the measured flow rate of the produced gas to the measured flow rate of the produced oil. In some implementations, at the beginning of a gas breakthrough, the GOR may show some variations. For example, the GOR can be higher than or equal to the original GOR at the beginning of a gas breakthrough. However, the GOR can continue to increase after the initial transitional gas breakthrough or during a stabilized gas breakthrough. In some implementations, the computer system determines the first increasing trend of GOR through a regression process of the calculated GOR data over the predetermined period of time. More specifically, the computer system determines the first increasing trend of GOR if the GOR after regression is increasing over the predetermined period of time.

In the second step, the computer system determines, based on the received composition measurement data, that a second increasing trend of a total percentage of compositions of the injected gas in produced fluids of the producing well occurs within the predetermined period of time. In some implementations, the mole fractions of the carbon numbers in the compositions of the hydrocarbons produced from the producing well and affected by the gas breakthrough can depend on the compositions of injected gas (e.g., injected lean gas 302 of FIG. 3). For example, when a breakthrough of injected gas in the producing well occurs, the mole fractions of $C_1$ and $C_2$, which are the lighter carbon numbers in the compositions of the injected gas, can be detected in the compositions of the hydrocarbons produced from the producing well, using, for example, a multiphase tester (e.g., phase tester 308 of FIG. 3). As more injected gas gets into the producing well during the breakthrough, the mole fractions of $C_1$ and $C_2$ in the compositions of the hydrocarbons produced from the producing well can increase over time. Therefore, when the breakthrough of injected gas in the producing well occurs and during the predetermined period of time, the mole fractions of both $C_1$ and $C_2$ can be consistently higher than the initial mole fractions of $C_1$ and $C_2$ at the beginning of the breakthrough of injected gas in the producing well, and can continue to increase during the predetermined period of time. Based on the composition data of the produced hydrocarbons from the producing well and measured by the multiphase test over the predetermined period of time, the second increasing trend can be determined using a regression process similar to the one used for determining the first increasing trend described above.

In some implementations, the computer system can select the predetermined period of time based on the formation characteristics of the producing well, such as heterogeneity and permeability.

In some implementations, once the computer system determines that both the first increasing trend and the second increasing trend occur within the predetermined period of time, it detects an occurrence of the breakthrough of the injected gas in the producing well.

In step 108, the computer system enhances oil recovery from the producing well based on the detected occurrence of the breakthrough of the injected gas in the producing well. In some implementations, the computer system enhances oil recovery by improving cyclic gas injection based on the detected occurrence of the breakthrough of the injected gas in the producing well. For example, existing perforations for gas injection can be cement-squeezed off, and the formation can be re-perforated in different intervals in order to change the flowing paths for the injected gas for displacing in-situ oil. Due to the complexity of the flowing paths inside the porous media such as tortuosity, change of flowing paths of the injected gas can displace more oil toward the producing well. Numerical simulation can also be performed to find any trapped oil zones where new in-fill wells can be drilled.

Figure 2:
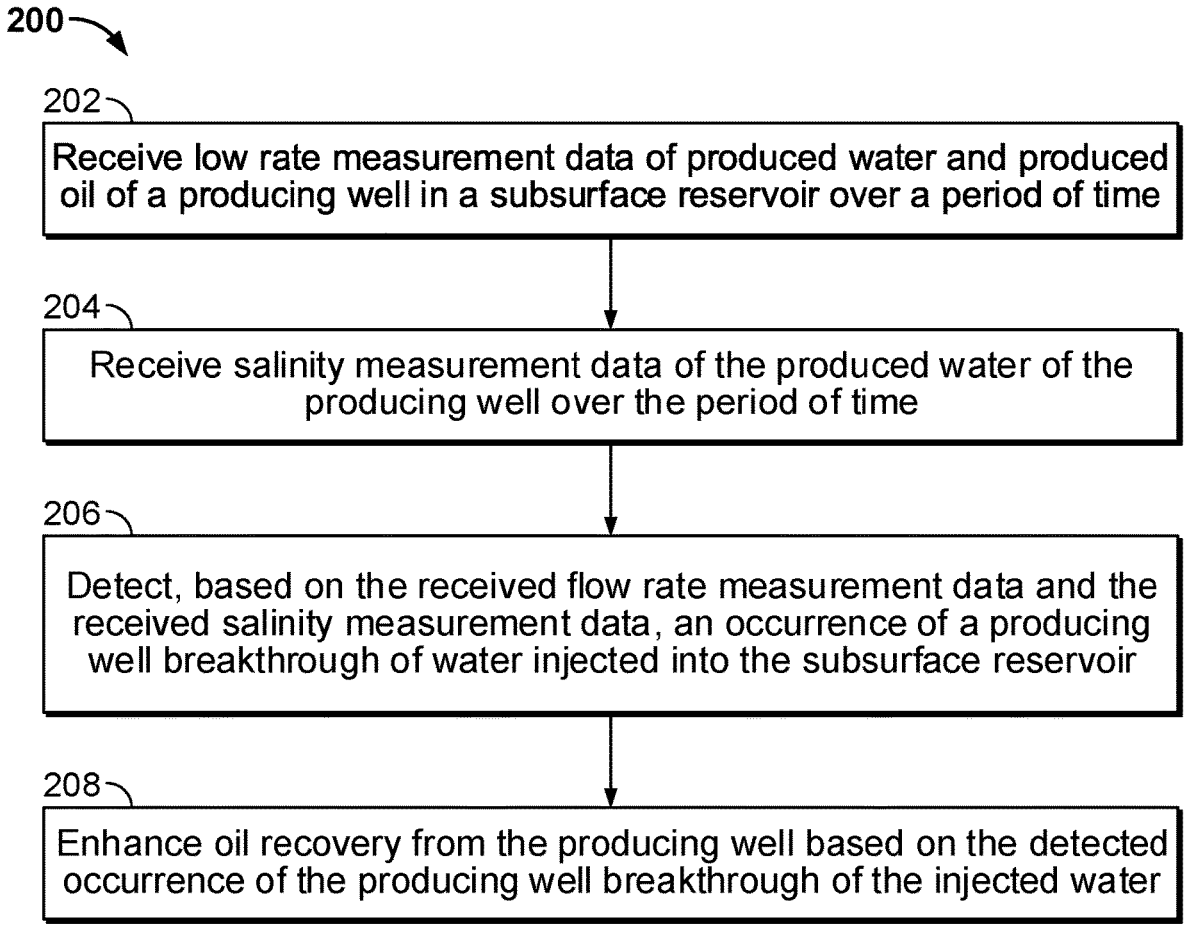
FIG. 2 illustrates an example workflow for determining an occurrence of water breakthrough into a producing well, according to some implementations.

FIG. 2 illustrates an example workflow 200 for determining an occurrence of water breakthrough into a producing well. In some implementations, to detect the water breakthrough into a producing well, a breakthrough detection system collects different fluid flow measurement data and water salinity measurement data. For convenience, workflow 200 will be described as being performed by a system of one or more computers (e.g., the breakthrough detection system), located in one or more locations, and programmed appropriately in accordance with this specification.

In step 202, a computer system receives flow rate measurement data of produced water and produced oil of a producing well in a subsurface reservoir that is measured over a period of time. In some implementations, the flow rate measurement data of produced water and produced oil can be measured using a multiphase tester. The multiphase tester can be a surface multiphase tester located downstream of a wellhead. An example multiphase tester is the phase tester 308 of FIG. 3.

In step 204, the computer system receives salinity measurement data of the produced water of the producing well over the period of time. In some implementations, the salinity measurement data can be measured by a multiphase tester, for example, phase tester 308 of FIG. 3.

In step 206, the computer system determines, based on the received flow rate measurement data and the received salinity measurement data, an occurrence of a producing well breakthrough of water injected into the subsurface reservoir. In some implementations, this determination process includes two steps.

In the first step, the computer system determines, based on the received flow rate measurement data, that an increasing trend of water cut of the produced water occurs within a predetermined period of time. The computer system can calculate the water cut as a ratio of the measured water flow rate to the measured total liquid rate (e.g., measured oil flow rate plus measured water flow rate) in a produced fluid stream of the producing well. In some implementations, the water cut can continue to increase during a stabilized water breakthrough. In some implementations, the computer system determines the increasing trend of water cut through a regression process of the calculated water cut data over the predetermined period of time, and an increasing trend of water cut can be determined if the water cut after regression is increasing over the predetermined period of time.

In the second step, the computer system determines, based on the received salinity measurement data, that a decreasing trend of salinity of the produced water of the producing well occurs within the predetermined period of time. The computer system can determine the decreasing trend using a regression process similar to the one used for determining the increasing trend of water cut described above.

In some implementations, the computer system can select the predetermined period of time based on the formation characteristics of the producing well, such as heterogeneity and permeability. For example, the predetermined period of time can be four to five days. A longer time interval such as ten to thirty days can also be used depending on the oil operating company.

In some implementations, once the computer system determines that both the increasing trend and the decreasing trend occur within the predetermined period of time, it detects an occurrence of the producing well breakthrough of water injected into the subsurface reservoir from one or more injection wells.

In step 208, the computer system enhances oil recovery from the producing well based on the detected occurrence of the breakthrough of the injected water in the producing well. In some implementations, the computer system enhances oil recovery by improving cyclic water rejection based on the detected occurrence of the breakthrough of the injected water in the producing well.

Figure 4:
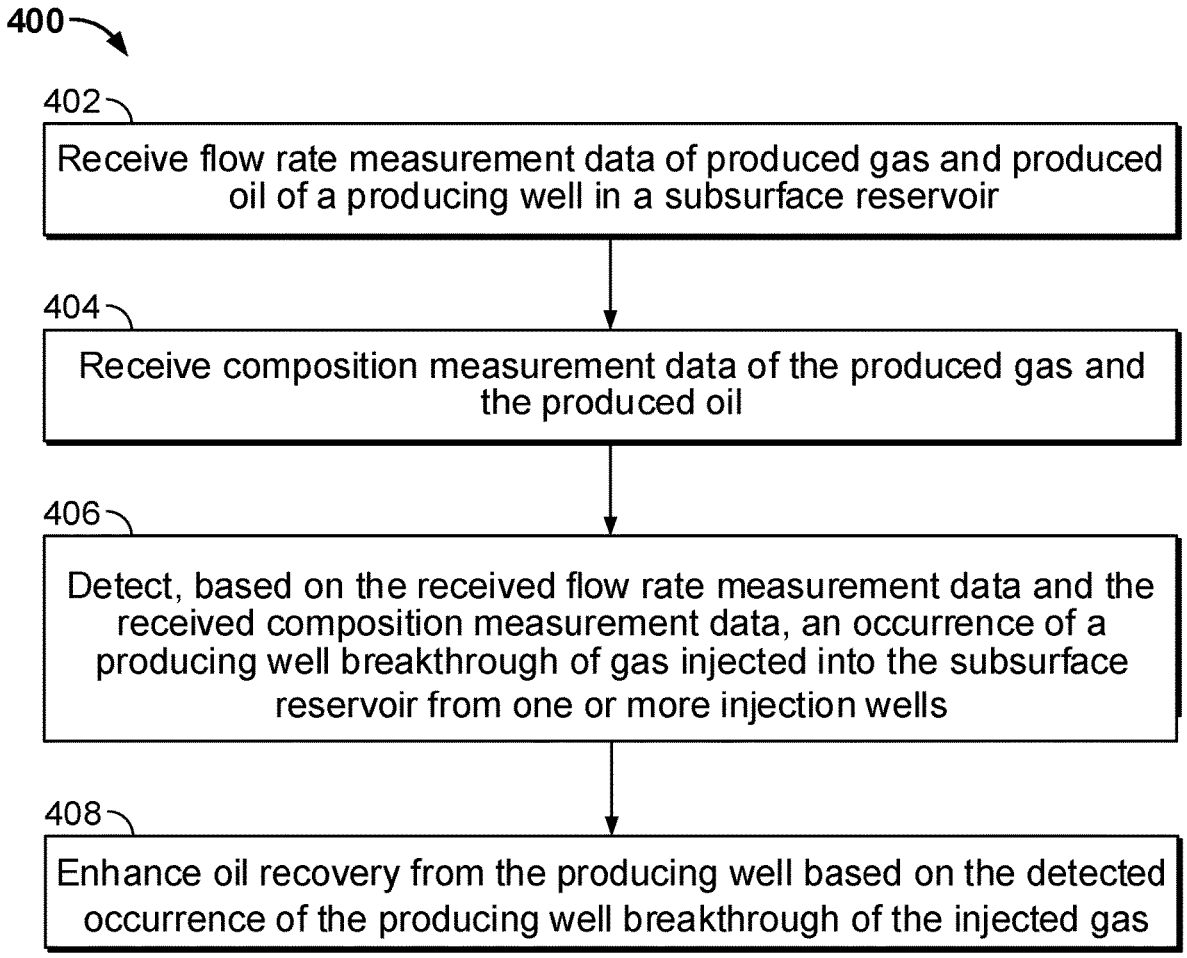
FIG. 4 illustrates an example process of detecting gas breakthrough in producing wells, according to some implementations.

FIG. 4 illustrates an example process 400 of detecting gas breakthrough in producing wells. For convenience, the process 400 will be described as being performed by a system of one or more computers, located in one or more locations, and programmed appropriately in accordance with this specification.

In step 402, a computer system receives flow rate measurement data of produced gas and produced oil of a producing well in a subsurface reservoir.

In step 404, the computer system receives composition measurement data of the produced gas and the produced oil.

In step 406, the computer system detects, based on the received flow rate measurement data and the received composition measurement data, an occurrence of a producing well breakthrough of gas injected into the subsurface reservoir from one or more injection wells.

In step 708, the computer system enhances oil recovery from the producing well based on the detected occurrence of the producing well breakthrough of the injected gas.

Figure 5:
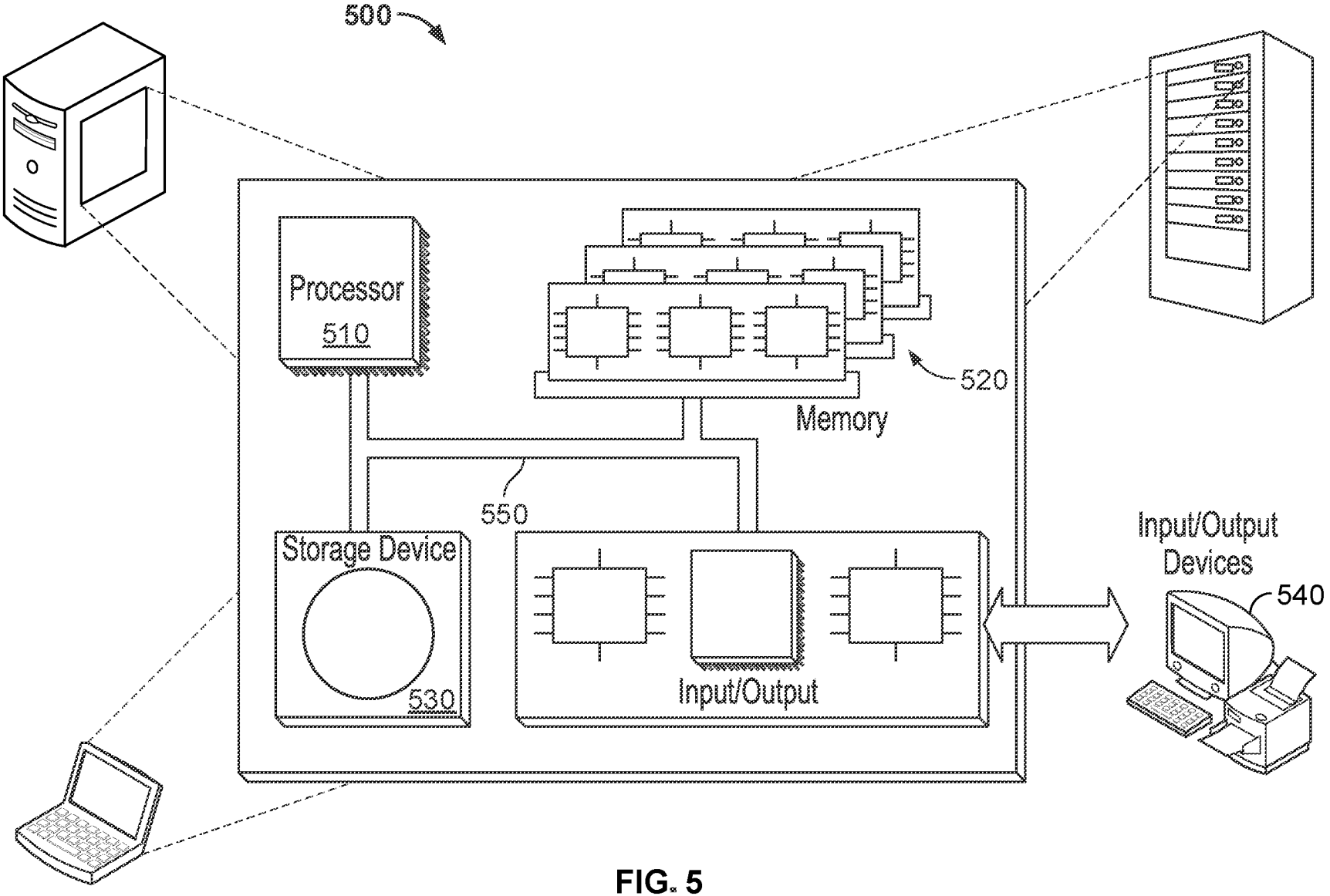
FIG. 5 is a schematic illustration of example computer systems that can be used to execute implementations of the present disclosure.

FIG. 5 illustrates a schematic diagram of an example computing system 500. The system 500 can be used for the operations described in association with the implementations described herein. For example, the system 500 may be included in any or all of the server components discussed herein. The system 500 includes a processor 510, a memory 520, a storage device 530, and an input/output device 540. The components 510, 520, 530, and 540 are interconnected using a system bus 550. The processor 510 is capable of processing instructions for execution within the system 500. In some implementations, the processor 510 is a single-threaded processor. The processor 510 is a multi-threaded processor. The processor 510 is capable of processing instructions stored in the memory 520 or on the storage device 530 to display graphical information for a user interface on the input/output device 540.

The memory 520 stores information within the system 500. In some implementations, the memory 520 is a computer-readable medium. The memory 520 is a volatile memory unit. The memory 520 is a non-volatile memory unit. The storage device 530 is capable of providing mass storage for the system 500. The storage device 530 is a computer-readable medium. The storage device 530 may be a floppy disk device, a hard disk device, an optical disk device, or a tape device. The input/output device 540 provides input/output operations for the system 500. The input/output device 540 includes a keyboard and/or pointing device. The input/output device 540 includes a display unit for displaying graphical user interfaces.

Certain aspects of the subject matter described here can be implemented as a method. Flow rate measurement data of produced gas and produced oil of a producing well in a subsurface reservoir are received. Composition measurement data of the produced gas and the produced oil are received. An occurrence of a producing well breakthrough of gas injected into the subsurface reservoir from one or more injection wells is detected based on the received flow rate measurement data and the received composition measurement data. Oil recovery from the producing well is enhanced based on the detected occurrence of the producing well breakthrough of the injected gas.

An aspect taken alone or combinable with any other aspect includes the following features. Detecting the occurrence of the producing well breakthrough of the injected gas includes determining, based on the received flow rate measurement data, that a first increasing trend of gas oil ratio of the produced gas and the produced oil occurs within a predetermined period of time; determining, based on the received composition measurement data, that a second increasing trend of a total percentage of compositions of the injected gas in produced fluids of the producing well occurs within the predetermined period of time; and in response to determining that both the first increasing trend and the second increasing trend occur within the predetermined period of time, detecting the occurrence of the producing well breakthrough of the injected gas.

An aspect taken alone or combinable with any other aspect includes the following features. The one or more injection wells are adjacent to the producing well.

An aspect taken alone or combinable with any other aspect includes the following features. The composition measurement data includes mole fraction measurement data of compositions of the produced gas and the produced oil.

An aspect taken alone or combinable with any other aspect includes the following features. The flow rate measurement data and the composition measurement data are from a multiphase tester coupled to the producing well An aspect taken alone or combinable with any other aspect includes the following features. Measurement data of the multiphase tester further includes flow measurement data of produced water from the producing well.

An aspect taken alone or combinable with any other aspect includes the following features. The multiphase tester is a surface multiphase tester.

Certain aspects of the subject matter described here can be implemented as a method. Flow rate measurement data of produced water and produced oil of a producing well in a subsurface reservoir are received. Salinity measurement data of the produced water of the producing well are received. An occurrence of a producing well breakthrough of water injected into the subsurface reservoir from one or more injection wells is detected based on the received flow rate measurement data and the received salinity measurement data. Oil recovery from the producing well is enhanced based on the detected occurrence of the producing well breakthrough of the injected water.

An aspect taken alone or combinable with any other aspect includes the following features. Detecting the occurrence of the producing well breakthrough of the injected water includes determining, based on the received flow rate measurement data, that an increasing trend of water cut of the produced water occurs within a predetermined period of time; determining, based on the received salinity measurement data, that a decreasing trend of salinity of the produced water of the producing well occurs within the predetermined period of time; and in response to determining that both the increasing trend and the decreasing trend occur within the predetermined period of time, detecting the occurrence of the producing well breakthrough of water injected into the subsurface reservoir from the one or more injection wells.

An aspect taken alone or combinable with any other aspect includes the following features. The one or more injection wells are adjacent to the producing well.

An aspect taken alone or combinable with any other aspect includes the following features. The flow rate measurement data and the salinity measurement data are from a multiphase tester coupled to the producing well.

An aspect taken alone or combinable with any other aspect includes the following features. Measurement data of the multiphase tester further includes flow measurement data of produced gas from the producing well.

An aspect taken alone or combinable with any other aspect includes the following features. The multiphase tester is a surface multiphase tester.

Certain aspects of the subject matter described in this disclosure can be implemented as a non-transitory computer-readable medium storing instructions which, when executed by one or more processors perform operations including the methods described here.

Certain aspects of the subject matter described in this disclosure can be implemented as a computer-implemented system that includes one or more computers and one or more computer memory devices interoperably coupled with the one or more computers and having tangible, non-transitory, machine-readable media storing one or more instructions that, when executed by the one or more computers, cause the computer-implemented system to perform operations including the methods described here.

Implementations and all of the functional operations described in this specification may be realized in digital electronic circuitry, or in computer software, firmware, or hardware, including the structures disclosed in this specification and their structural equivalents, or in combinations of one or more of them. Implementations may be realized as one or more computer program products (i.e., one or more modules of computer program instructions encoded on a computer readable medium for execution by, or to control the operation of, data processing apparatus). The computer readable medium may be a machine-readable storage device, a machine-readable storage substrate, a memory device, a composition of matter effecting a machine-readable propagated signal, or a combination of one or more of them. The term "computing system" encompasses all apparatus, devices, and machines for processing data, including by way of example a programmable processor, a computer, or multiple processors or computers. The apparatus may include, in addition to hardware, code that creates an execution environment for the computer program in question (e.g., code that constitutes processor firmware, a protocol stack, a database management system, an operating system, or any appropriate combination of one or more thereof). A propagated signal is an artificially generated signal (e.g., a machine-generated electrical, optical, or electromagnetic signal) that is generated to encode information for transmission to suitable receiver apparatus.

A computer program (also known as a program, software, software application, script, or code) may be written in any appropriate form of programming language, including compiled or interpreted languages, and it may be deployed in any appropriate form, including as a stand-alone program or as a module, component, subroutine, or other unit suitable for use in a computing environment. A computer program does not necessarily correspond to a file in a file system. A program may be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program may be deployed to be executed on one computer or on multiple computers that are located at one site or distributed across multiple sites and interconnected by a communication network.

The processes and logic flows described in this specification may be performed by one or more programmable processors executing one or more computer programs to perform functions by operating on input data and generating output. The processes and logic flows may also be performed by, and apparatus may also be implemented as, special purpose logic circuitry (e.g., an FPGA (field programmable gate array) or an ASIC (application specific integrated circuit)).

Processors suitable for the execution of a computer program include, by way of example, both general and special purpose microprocessors, and any one or more processors of any appropriate kind of digital computer. Generally, a processor will receive instructions and data from a read only memory or a random access memory or both. Elements of a computer can include a processor for performing instructions and one or more memory devices for storing instructions and data. Generally, a computer will also include, or be operatively coupled to receive data from or transfer data to, or both, one or more mass storage devices for storing data (e.g., magnetic, magneto optical disks, or optical disks). However, a computer need not have such devices. Moreover, a computer may be embedded in another device (e.g., a mobile telephone, a personal digital assistant (PDA), a mobile audio player, a Global Positioning System (GPS) receiver). Computer readable media suitable for storing computer program instructions and data include all forms of non-volatile memory, media and memory devices, including by way of example semiconductor memory devices (e.g., EPROM, EEPROM, and flash memory devices); magnetic disks (e.g., internal hard disks or removable disks); magneto optical disks; and CD ROM and DVD-ROM disks. The processor and the memory may be supplemented by, or incorporated in, special purpose logic circuitry.

To provide for interaction with a user, implementations may be realized on a computer having a display device (e.g., a CRT (cathode ray tube), LCD (liquid crystal display) monitor) for displaying information to the user and a keyboard and a pointing device (e.g., a mouse, a trackball, a touch-pad), by which the user may provide input to the computer. Other kinds of devices may be used to provide for interaction with a user as well; for example, feedback provided to the user may be any appropriate form of sensory feedback (e.g., visual feedback, auditory feedback, tactile feedback); and input from the user may be received in any appropriate form, including acoustic, speech, or tactile input.

Implementations may be realized in a computing system that includes a back end component (e.g., as a data server), a middleware component (e.g., an application server), and/or a front end component (e.g., a client computer having a graphical user interface or a Web browser, through which a user may interact with an implementation), or any appropriate combination of one or more such back end, middleware, or front end components. The components of the system may be interconnected by any appropriate form or medium of digital data communication (e.g., a communication network). Examples of communication networks include a local area network ("LAN") and a wide area network ("WAN"), e.g., the Internet.

The computing system may include clients and servers. A client and server are generally remote from each other and typically interact through a communication network. The relationship of client and server arises by virtue of computer programs running on the respective computers and having a client-server relationship to each other.

While this specification contains many specifics, these should not be construed as limitations on the scope of the disclosure or of what may be claimed, but rather as descriptions of features specific to particular implementations. Certain features that are described in this specification in the context of separate implementations may also be implemented in combination in a single implementation. Conversely, various features that are described in the context of a single implementation may also be implemented in multiple implementations separately or in any suitable sub-combination. Moreover, although features may be described above as acting in certain combinations and even initially claimed as such, one or more features from a claimed combination may in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems may generally be integrated together in a single software product or packaged into multiple software products.

A number of implementations have been described. Nevertheless, it will be understood that various modifications may be made without departing from the spirit and scope of the disclosure. For example, various forms of the flows shown above may be used, with steps re-ordered, added, or removed. Accordingly, other implementations are within the scope of the following claims.

We claim:

1. A computer-implemented method comprising:

receiving flow rate measurement data of produced gas and produced oil of a producing well in a subsurface reservoir;

receiving composition measurement data of the produced gas and the produced oil, wherein the composition measurement data comprises mole fraction measurement data of carbon numbers C1 and C2 in the produced gas and the produced oil;

detecting, based on the received flow rate measurement data and the received composition measurement data, an occurrence of a producing well breakthrough of gas injected into the subsurface reservoir from one or more injection wells;

enhancing oil recovery from the producing well based on the detected occurrence of the producing well breakthrough of the injected gas; and in response to detecting the occurrence of the producing well breakthrough of the injected gas, performing a remedial action comprising one of: cement-squeezing perforations, re-perforating wells, or performing numerical simulations to identify trapped oil zones for drilling new wells.

2. The computer-implemented method of claim 1, wherein detecting the occurrence of the producing well breakthrough of the injected gas comprises:

determining, based on the received flow rate measurement data, that a first increasing trend of gas oil ratio (GOR) of the produced gas and the produced oil occurs within a predetermined period of time;

determining, based on the received composition measurement data, that a second increasing trend of a total percentage of compositions of the injected gas in produced fluids of the producing well occurs within the predetermined period of time; and in response to determining that both the first increasing trend and the second increasing trend occur within the predetermined period of time, detecting the occurrence of the producing well breakthrough of the injected gas.

3. The computer-implemented method of claim 1, wherein the one or more injection wells are adjacent to the producing well.

4. The computer-implemented method of claim 1, wherein the composition measurement data comprises mole fraction measurement data of compositions of the produced gas and the produced oil.

5. The computer-implemented method of claim 1, wherein the flow rate measurement data and the composition measurement data are from a multiphase tester coupled to the producing well.

6. The computer-implemented method of claim 5, wherein measurement data of the multiphase tester further comprises salinity measurement data of produced water from the producing well.

7. The computer-implemented method of claim 6, wherein the multiphase tester is a surface multiphase tester.

* * * * *